United States Patent [19]

Gilbert

[11] Patent Number: 4,597,605

[45] Date of Patent: Jul. 1, 1986

[54] COMBINED TOTE BAG AND SEAT CUSHION

[76] Inventor: Robert W. Gilbert, 8230 Mortenview, Taylor, Mich. 48180

[21] Appl. No.: 667,961

[22] Filed: Nov. 5, 1984

[51] Int. Cl.[4] ..... A47G 7/62

[52] U.S. Cl. ..... 297/219; 297/191; 5/419

[58] Field of Search ..... 299/352, 219, 224, 229, 299/382, 441, 191; 5/465, 466, 419, 420, 462

[56] References Cited

U.S. PATENT DOCUMENTS

| | | | |
|---|---|---|---|
| 2,227,180 | 12/1940 | Falk | 297/229 X |
| 2,270,598 | 1/1942 | Morgan | 297/191 |
| 3,066,980 | 12/1962 | Clute | 297/352 X |
| 3,259,925 | 7/1966 | Tilles | 297/219 X |
| 3,515,430 | 6/1970 | Nelson | 297/219 X |
| 3,700,278 | 10/1972 | Gulba | 297/191 |
| 4,190,918 | 3/1980 | Harvell | 297/219 X |
| 4,466,517 | 8/1984 | Spiegelman | 5/419 X |

FOREIGN PATENT DOCUMENTS

| | | | |
|---|---|---|---|
| 2907241 | 9/1979 | Fed. Rep. of Germany | 297/191 |
| 1107295 | 8/1975 | France | 297/219 |

*Primary Examiner*—William E. Lyddane
*Assistant Examiner*—Peter A. Aschenbrenner
*Attorney, Agent, or Firm*—Barnes, Kisselle, Raisch, Choate, Whittemore & Hulbert

[57] ABSTRACT

A combined tote bag and seat cushion which comprise a pair of rectangular cushions joined to each other by a fabric hinge. A tote pocket is affixed to and projects from the end edge of one cushion remote from the hinge. A pair of elastic straps extend between cushion-remote corners of the tote pocket and the adjacent cushion side edges so as to form an elastic pocket for removably affixing the cushion over the back of a folding chair or the like. Handle straps centrally project from the remote end edges of the cushions and from the free lip of the tote pocket for transporting the combined tote bag and seat cushion in a folded configuration.

3 Claims, 5 Drawing Figures

COMBINED TOTE BAG AND SEAT CUSHION

The present invention is directed to removable seat cushions for folding chairs and like applications.

Folding chairs provided for bingo participants and similar uses are generally uncomfortable for long periods of use. It is therefore a general object of the present invention to provide a portable seat cushion for such folding chairs which may not only be readily transported to and removably fitted over a variety of folding chair geometries, but which also includes facility in the nature of a tote bag for transporting paraphernalia for use during play of the bingo games. A specific object of the invention is to provide a combined tote bag and seat cushion of the described character which is economical to manufacture and assemble, which is light in weight and readily transportable, which is comfortable in use, which may be repaired by the owner in the event of damage and/or which may be readily cleaned if soiled.

The invention, together with additional objects, features and advantages thereof, will be best understood from the following description, the appended claims and the accompanying drawing in which:

Figure 1:
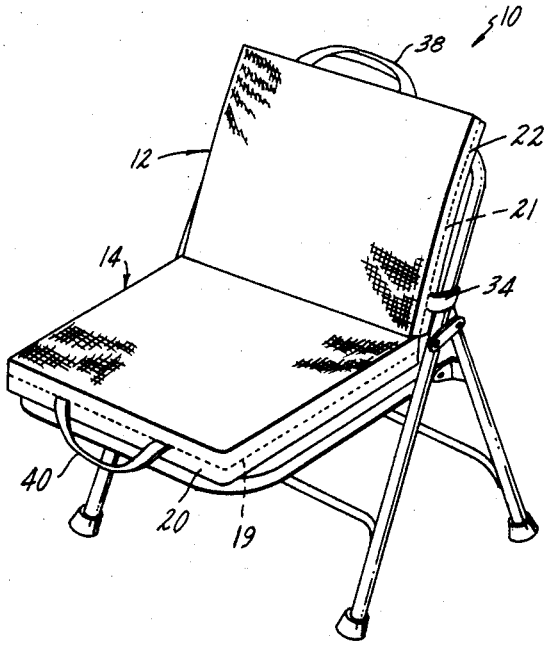
FIG. 1 is a front perspective view of a combined tote bag and seat cushion in accordance with the invention fitted onto a conventional folding chair and ready for use.

The drawing illustrates a presently preferred embodiment 10 of a combined tote bag and seat cushion in accordance with the invention as comprising first and second flat rectangular cushions 12,14 of identical peripheral outline. Each cushion 12,14 includes a resilient pad 16,17 (FIG. 3) of urethane foam or the like removably contained within a closely fitting rectangular case 18,20 of suitable fabric. Each case 18,20 is constructed of two fabric sections stitched to each other in a continuous seam 19,21 which extends around the end edges and one side edge of cases 18,20. The remaining side edge of each case 18,20 includes a zipper 22 (FIG. 2) for removing the associated foam pad, so that the remainder of the combined tote bag and seat cushion may be placed in a washing machine for cleaning.

Figure 2:
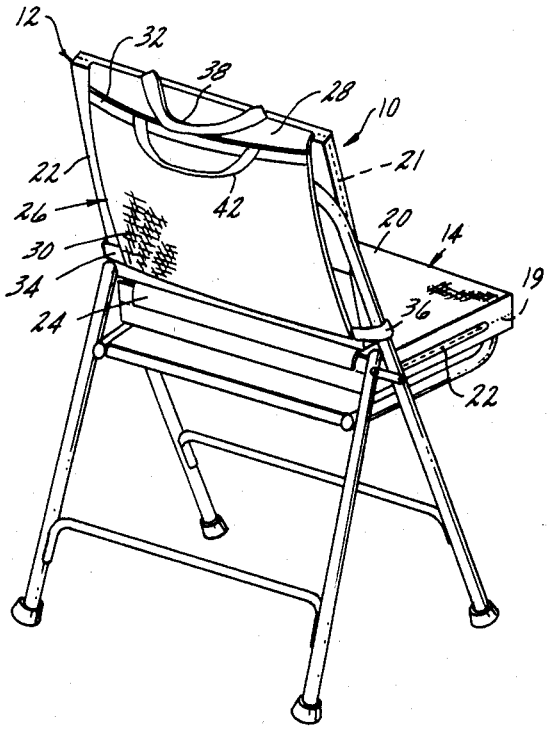
FIG. 2 is a rear perspective view of the invention as illustrated in FIG. 1.
Figure 4:
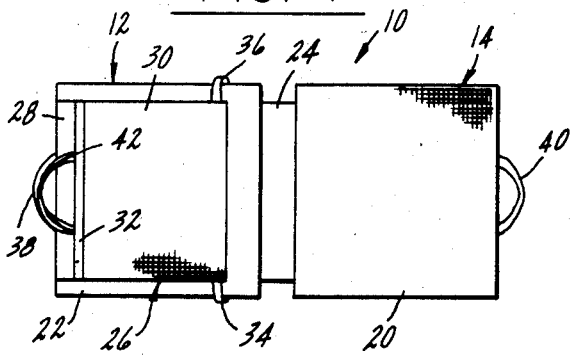
FIG. 4 is a top plan view of the invention unfolded and lying in a plane.
Figure 3:
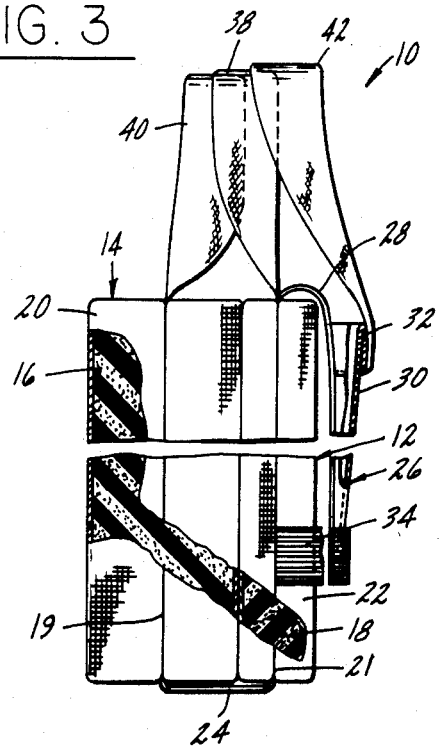
FIG. 3 is a partially sectioned side elevational view of the combined tote bag and seat cushion of the invention folded and ready for transportation.

A fabric hinge 24 joins an end edge of seat cushion 12 to an end edge of seat cushion 14 such that the seat cushion side edges are coplanar. Hinge 24 comprises the same fabric as do cases 18,20 and is doubled upon itself for enhanced strength. Hinge 24 is generally rectangular in peripheral outline, as best seen in FIG. 4, and is joined to each cushion 12,14 at associated seam 21,19, extending lengthwise of the opposing cushion end edges between the cushion side edges. Hinge 24 is of sufficient dimension between the opposing cushion end edges, as best seen in FIG. 3, to permit the cushions 12,14 to be folded in facing engagement with peripheries alined, and to be unfolded or rotated with respect to each other to at least the obtuse angle formed by a conventional folding chair back and seat (FIGS. 1 and 2). In practice, of course, with fabric hinge 24 being attached to seams 19,21 at about the mid-plane of cushions 12,14 (FIG. 3), the seat cushions may be folded upon themselves in facing engagement in either direction.

A flap 26 is affixed to cushion 12 at an end edge thereof remote from hinge 24 and cooperates therewith for removably affixing the combination onto a folding chair, and also to function as a tote bag pocket. More specifically flap 26 includes a first fabric panel 28 of rectangular outline affixed at one end to seam 21 by a continuous stitch joint. A second rectangular fabric panel 30 is affixed by a continuous seam around the remaining three edges of panel 28, the free edge of panel 30 adjacent to cushion 12 being separate from panel 28. Thus panels 28,30 form a rectangular pocket which opens away from cushion 12. It will be noted with particular reference to FIGS. 2 and 3 that the free edge or lip 32 of panel 30 is doubled upon itself for strength and is disposed beneath the adjacent end edge of cushion 12 in the folded orientation of the combination. Panel 28 is of the same fabric as is the remainder of the assembly.

A pair of elastic straps 34,36 extend between the cushion-remote corners of flap/pocket 26 and the adjacent side edge portions of cushion 12, being stitched thereto at seam 21. A pair of handle straps 38,40 have ends affixed to respective remote end edges of cushions 12,14 at seams 21,19 so as to project centrally therefrom. An additional handle strap 42 has ends stitched to lip 32 of panel 30 so as to project centrally therefrom in general alignment with handle straps 38,40 in the folded configuration of the invention.

Figure 5:
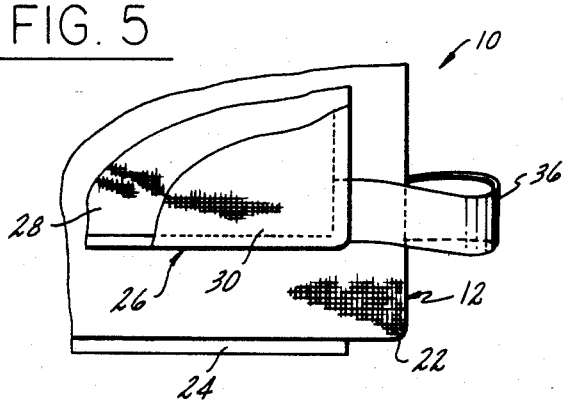
FIG. 5 is a fragmentary side elevational view taken from the direction 5 in FIG. 4.

In use, the combined tote bag and seat cushion may be folded upon itself as shown in FIGS. 3 and 5, and readily transported to and from the location of use, such as a bingo hall or the like. Various paraphernalia used during play may be stored within flap pocket 26 during such transportation. Handle 42 helps support flap/pocket 26 against the weight of such paraphernalia during transportation. Upon arrival at the use site, cushion 14 may be dropped by releasing handle 40. Cushion 12 is positioned over the chair, with the chair back being releasably held in the pocket formed by elastic straps 34,36 between cushion 12 and flap/pocket 26. In this connection the use of elastic straps 34,36 readily accommodates a variety of seat back widths. Materials may be readily removed from tote pocket 26, and excess material stored therein until needed. When ready for departure, the entire assembly may be readily removed from the folding chair by folding cushion 14 upwardly against cushion 12, and then grasping the aligned handles 38-42 and pulling upwardly.

Although the invention has been described in detail in conjunction with a presently preferred embodiment thereof illustrated in the drawing, it will be readily apparent that a number of modifications or variations may be implemented without departing from the principles of the invention. For example, tote pocket flap panels 28,30 may comprise a single panel folded upon itself and continuously stitched along the panel side edges.

The invention claimed is:

1. A combined tote bag and seat cushion comprising:

rectangular cushion means having side and end edges, said cushion means being adapted to fold double upon itself such that said end edges of said cushion means are adjacent to each other, a flap forming a pocket affixed to one end edge of said cushion means, said pocket having closed sides, one closed end and an open end adjacent to said one end edge of said cushion means, a pair of elastic straps respectively extending between and resiliently joinig corners of said pocket remote from said one cushion end edge and said side edge of said cushion means, said pocket having peripheral dimensions along its said side ends which are not greater than peripheral dimensions of said cushion means folded double upon itself, and a pair of handle straps projecting from and having ends joined to corresponding remote end edges of said cushion means and a third handle strap having ends joined to said open end of said pocket for grasping and transporting said cushion means and pocket with said cushion means folded double upon itself.

2. A combined tote bag and seat cushion adapted to be removably received on a folding chair or the like comprising:

first and second flat rectangular cushions each having ends and side edges and having substantially identical peripheral dimensions, hinge means joining an opposed end edges of each said cushion such that said cushions may pivot with respect to each other at least between an obtuse angle and a position in which said cushions are in flat facing engagement, first rectangular flap means having an end edge joined to the end edge of said first cushion remote from said hinge means, the joint between said first flap means and said first cushion being a continous joint extending along said end edges of said first flap means and said first cushion, means joining side edges of said first flap means to opposing side edges of first cushion so as to form a pocket between said first flap means and said first cushion adapted to be removably slidably received over a back of a folding chair of the like such that said second cushion rests upon the chair seat, said joining means comprising a pair of elastic straps respectively extending between ends of said side edges of said first flap means remote from said first cushion and adjacent to seat edge portions of said first cushion, the remainder of said side edges of said first flap means being separate from said side edges of said first cushion, second rectangular flap means joined to said first flap means along said side edges of said first flap means and along an end edge of said first flap means remote from said first cushion, said first and second flap means being separate along end edges thereof adjacent to said first cushion, peripheral dimensions of said joined first and second flap means being not greater than peripheral dimensions of said cushions, and handle means comprising first and second identical handle straps each having ends affixed to end centrally projecting from end edges of said cushions remote from said hinge means and a third handle strap having ends affixed to said second flap means adjacent to said first cushions so as to cooperate with said first and second straps when said cushions are in facing engagement for grasping and transporting said combined tote bag and seat cushion with said first and second flap means forming a tote pocket opening adjacent to said handle means.

3. A combined tote bag and seat cushion comprising:

first and second rectangular cushions of identical peripheral outline, each said cushion comprising a resilient pad encased in fabric, a fabric hinge joining an end edge of said first cushion to an end edge of said second cushion such that adjacent side edges of said cushions are coplanar, said fabric hinge having a continuous joint to said cushion end edges and extending lengthwise of said end edges between said cushion side edges, a tote pocket comprising a first rectangular fabric panel continuously joined along one edge to an end edge of said first cushion remote from said hinge, and a second rectangular fabric panel continuously joined along three edges to the three edges of said first panel other than said one edge, elastic means extending between corners of said tote pocket remote from said one edge and adjacent side edges of said first cushion, and handle straps centrally projecting from hinge-remote end edges of said first and second cushions and from the fourth edge of said second panel.

* * * * *